US011293595B2

(12) United States Patent
Chae

(10) Patent No.: US 11,293,595 B2
(45) Date of Patent: Apr. 5, 2022

(54) HYDROGEN FUELING SYSTEM AND METHOD BASED ON REAL-TIME COMMUNICATION INFORMATION FROM CHSS FOR FUEL CELL

(71) Applicant: Mirae EHS-code Research Institute, Seoul (KR)

(72) Inventor: Chung Keun Chae, Seoul (KR)

( * ) Notice: Subject to any disclaimer, the term of this patent is extended or adjusted under 35 U.S.C. 154(b) by 0 days.

(21) Appl. No.: 17/001,699

(22) Filed: Aug. 25, 2020

(65) Prior Publication Data

US 2021/0310616 A1 Oct. 7, 2021

(30) Foreign Application Priority Data

Apr. 1, 2020 (KR) ..... 10-2020-0039619
May 19, 2020 (KR) ..... 10-2020-0059889

(51) Int. Cl.
*F17C 13/04* (2006.01)
*F17C 7/02* (2006.01)
*F17C 13/02* (2006.01)

(52) U.S. Cl.
CPC ..... *F17C 13/04* (2013.01); *F17C 7/02* (2013.01); *F17C 13/025* (2013.01);
(Continued)

(58) Field of Classification Search
CPC ..... F17C 13/04; F17C 13/025; F17C 7/02; F17C 13/026; F17C 2250/043;
(Continued)

(56) References Cited

U.S. PATENT DOCUMENTS 5,259,424 A * 11/1993 Miller ..... F17C 5/007 137/80
5,551,490 A * 9/1996 Kountz ..... F17C 5/007 141/18

(Continued)

FOREIGN PATENT DOCUMENTS

JP 2014-177991 A 9/2014
JP 2017-150646 A 8/2017

(Continued)

OTHER PUBLICATIONS

English Specification of 10-2013-0061268.

(Continued)

*Primary Examiner* — Timothy L Maust
*Assistant Examiner* — James R Hakomaki
(74) *Attorney, Agent, or Firm* — Antonio Ha & U.S. Patent, LLC

(57) ABSTRACT

According to an embodiment, a hydrogen fueling system based on real-time communication of a compressed hydrogen storage system (CHSS) for a fuel cell comprises a CHSS including a hydrogen tank and a hydrogen tank valve, a dispenser including a dispenser controller receiving sensing data including a pressure and temperature inside the hydrogen tank and a hydrogen supply unit supplying hydrogen to an inside of the hydrogen tank based on the sensing data, and a data hydrogen moving device including a CHSS controller converting the sensing data into data for wireless communication and outputting the data, a wireless communication unit provided for wireless communication between the CHSS controller and the dispenser controller of the dispenser, and a receptacle transferring hydrogen from the hydrogen supply unit to the hydrogen tank valve.

16 Claims, 4 Drawing Sheets

(52) U.S. Cl.
CPC .... *F17C 13/026* (2013.01); *F17C 2205/0142* (2013.01); *F17C 2205/0323* (2013.01); *F17C 2221/012* (2013.01); *F17C 2250/034* (2013.01); *F17C 2250/043* (2013.01); *F17C 2250/0439* (2013.01); *F17C 2270/0184* (2013.01)

(58) Field of Classification Search
CPC ..... F17C 2205/0323; F17C 2250/0439; F17C 2221/012; F17C 2205/0142; F17C 2250/034; F17C 2270/0184
USPC ..... 141/4
See application file for complete search history.

(56) References Cited

U.S. PATENT DOCUMENTS 7,328,726 B2 * 2/2008 Cohen ..... B01F 3/028 141/9
8,020,589 B2 * 9/2011 Cohen ..... F17C 13/026 141/95
9,279,541 B2 3/2016 Cohen
9,605,804 B2 3/2017 Mathison
10,082,247 B1 * 9/2018 Sinding ..... F17C 5/06
2002/0014277 A1 * 2/2002 Togasawa ..... F17C 5/06 141/95
2003/0164202 A1 * 9/2003 Graham ..... F17C 5/06 141/98
2004/0163731 A1 * 8/2004 Eichelberger ..... F17C 5/06 141/284
2006/0071016 A1 * 4/2006 Diggins ..... F17C 7/02 222/3
2007/0079892 A1 * 4/2007 Cohen ..... F17C 13/025 141/105
2008/0000542 A1 1/2008 Cohen
2010/0213083 A1 * 8/2010 Olander ..... F17C 11/00 206/0.7
2011/0259469 A1 * 10/2011 Harty ..... F17C 13/025 141/4
2012/0125482 A1 * 5/2012 Mori ..... F17C 5/007 141/98
2012/0216915 A1 * 8/2012 Takata ..... F28D 7/14 141/82
2012/0227864 A1 * 9/2012 Mori ..... F17C 5/06 141/95
2013/0037165 A1 * 2/2013 Okawachi ..... F17C 5/06 141/4
2013/0240080 A1 * 9/2013 Pick ..... F17C 5/06 141/4
2014/0202584 A1 * 7/2014 Mathison ..... F17C 5/06 141/4
2014/0216599 A1 * 8/2014 Loewenthal ..... F17C 5/00 141/4
2014/0290790 A1 * 10/2014 Mathison ..... F17C 5/007 141/4
2014/0295305 A1 * 10/2014 Wake ..... H01M 8/04223 429/429
2014/0311622 A1 10/2014 Cohen
2015/0300570 A1 * 10/2015 Beuneken ..... F17C 5/02 141/4
2015/0308621 A1 * 10/2015 Mathison ..... F17C 5/007 141/4
2017/0074456 A1 * 3/2017 Handa ..... F17C 5/06
2017/0074707 A1 * 3/2017 Mathison ..... F17C 5/06
2018/0038550 A1 * 2/2018 Kondo ..... F17C 5/06
2018/0112828 A1 * 4/2018 Bourgeois ..... F17C 13/026
2018/0335181 A1 * 11/2018 Sinding ..... F17C 5/04
2018/0356270 A1 12/2018 Mathison
2019/0033119 A1 * 1/2019 Lease ..... F17C 13/02
2019/0074528 A1 * 3/2019 Mori ..... G05D 7/0617
2019/0084414 A1 * 3/2019 Fujita ..... B60K 15/07
2019/0093826 A1 * 3/2019 Araki ..... F17C 5/007
2019/0184847 A1 * 6/2019 Mathison ..... G05D 7/0617
2019/0301678 A1 10/2019 Yamaguchi
2020/0182410 A1 * 6/2020 Mathison ..... F17C 5/06
2020/0276909 A1 * 9/2020 Boisen ..... B60L 53/66
2020/0309323 A1 * 10/2020 Elgowainy ..... F17C 5/04
2020/0370694 A1 * 11/2020 Frenal ..... F17C 13/04
2021/0062973 A1 * 3/2021 Fukunaga ..... G01L 19/0092
2021/0062974 A1 * 3/2021 Tezuka ..... F17C 13/028

FOREIGN PATENT DOCUMENTS

JP 2020-031512 A 2/2020
KR 10-2012-0087129 8/2012
KR 10-2013-0061268 6/2013
KR 10-1337908 12/2013
WO WO2019235386 12/2019

OTHER PUBLICATIONS

English Specification of.
English Specification of JP2014-177991A.
English Specification of 10-2012-0087129.
English Specification of JP2020-031512A.
English Specification of 10-1337908.
English Specification of JP2017-150646A.
English Specification of WO2019235386.
English Abstract of Chungkeun Chae et al., "An Analysis of the Effect of Pressure Ramp Rate on the Major Parameters of the Standard Hydrogen Fueling Protocol," Journal of the Korean Institute of Gas 24(1), 2020-2, 23-32.

* cited by examiner

HYDROGEN FUELING SYSTEM AND METHOD BASED ON REAL-TIME COMMUNICATION INFORMATION FROM CHSS FOR FUEL CELL

CROSS-REFERENCE TO RELATED APPLICATION(S)

This application claims priority under 35 U.S.C. 119 to Korean Patent Application Nos. 10-2020-0039619, filed on Apr. 1, 2020, and 10-2020-0059889, filed on May 19, 2020, in the Korean Intellectual Property Office, the disclosures of which are herein incorporated by reference in their entireties.

TECHNICAL FIELD

Embodiments of the disclosure relate to a hydrogen fueling system and method based on real-time communication information from a CHSS for fuel cells and a protocol capable of quickly filling hydrogen tanks with hydrogen by measuring the temperature and pressure of the hydrogen tanks in real-time.

DESCRIPTION OF RELATED ART

A hydrogen vehicle is a vehicle that uses hydrogen fuel for motive power and converts the chemical energy of hydrogen to mechanical energy either by burning hydrogen in an internal combustion engine. Hydrogen, as a fuel for hydrogen vehicles, has the nature of quick fueling at a high pressure and has a risk as compared with use of fossil fuels and its full fueling is not easy due to the Joule-Thomson effect. Many countries have developed hydrogen fueling protocols and some of them use a lookup table regarding the pressure ramp rate and the target pressure based on parameters upon fueling. However, such conventional art does not perform fueling control based on measurements obtained in real-time and suffers from the need for creating of a complicated filling or fueling program based on numerous lookup tables and myriad conditions under the condition that various mobility devices, such as drones, boats, or forklifts, as well as vehicles, are being developed, and may thus not be adopted unless some conditions are met, failing to provide accurate fueling and control.

U.S. Patent Application Publication No. 2014-0311622 published on Oct. 23, 2014 and Korean Patent Application Publication No. 2013-0061268 published on Jun. 11, 2013 disclose a configuration of measuring, in real-time, the difference between the target temperature and sensing temperature upon filling a compressed hydrogen storage tank with hydrogen from a dispenser and controlling the filling flow of hydrogen to allow the sensing temperature to reach the target temperature and a method of measuring, in real-time, the degree of deformation in a compressed hydrogen storage tank and stopping hydrogen fueling upon detecting a preset degree of deformation.

However, the protocols disclosed in the prior art documents are not control protocols developed under the assumption of real-time communication, ending up turning back to the original issue that real-time hydrogen control is impossible. The reason why the protocols have been complicated comes from the incapability of communication or unreliable communication between the hydrogen refueling station and the vehicle. Thus, a need exists for research and development of a standardized protocol ensuring communication capable all the time and the reliability of communication.

Reliable communication allows the temperature and pressure, which are major risk factors for use of hydrogen as a fuel, to be monitored and predicted in real-time while calculating the pressure ramp rate and target pressure, thereby contributing to creation of a simplified protocol. Therefore, a robust communication protocol and a controlling method for real-time monitoring are needed.

SUMMARY

According to various embodiments, in order to fill hydrogen tanks with hydrogen more safely and quickly based on the structural information and thermodynamic information about the hydrogen tanks sent from the CHSS via wireless communication while filling the hydrogen tanks with hydrogen, the pressure and temperature of hydrogen inside the hydrogen tanks may be measured in real-time, and the dispenser may receive the pressure and temperature, which have been measured in real-time, from the CHSS via wireless communication, calculate the optimal pressure ramp rate, and allows hydrogen fueling to be performed at the optimal pressure ramp rate, thereby minimizing the fueling time within a range in which the hydrogen pressure, temperature, and state of charge (SOC) in the hydrogen tanks do not exceed preset thresholds. However, the objects of the embodiments are not limited thereto, and other objects may also be present.

According to an embodiment, a hydrogen fueling system based on real-time communication of a compressed hydrogen storage system (CHSS) for a fuel cell comprises a CHSS including a hydrogen tank and a hydrogen tank valve, a dispenser including a dispenser controller receiving sensing data including a pressure and temperature inside the hydrogen tank and a hydrogen supply unit supplying hydrogen to an inside of the hydrogen tank based on the sensing data, and a data hydrogen moving device including a CHSS controller converting the sensing data into data for wireless communication and outputting the data, a wireless communication unit provided for wireless communication between the CHSS controller and the dispenser controller of the dispenser, and a receptacle transferring hydrogen from the hydrogen supply unit to the hydrogen tank valve.

According to an embodiment, a hydrogen fueling method performed by a dispenser comprises gathering initial state values from a hydrogen supply unit of the dispenser and a hydrogen tank of a CHSS, determining a mass flow, a temperature and pressure inside the hydrogen tank, and a state of charge (SOC) using a pre-stored simple thermodynamic model based on the initial state value, calculating differences between the determined mass flow, temperature, and pressure and pre-stored respective safety thresholds of the determined mass flow, temperature, and pressure, and discovering and applying an optimal pressure ramp rate of the hydrogen supply unit based on the calculated differences.

According to various embodiments, in order to fill hydrogen tanks with hydrogen more safely and quickly based on the structural information and thermodynamic information about the hydrogen tanks sent from the CHSS via wireless communication while filling the hydrogen tanks with hydrogen, the pressure and temperature of hydrogen inside the hydrogen tanks may be measured in real-time, and the dispenser may receive the pressure and temperature, which have been measured in real-time, from the CHSS via wireless communication, calculate the optimal pressure ramp rate, and allows hydrogen fueling to be performed at the optimal pressure ramp rate, thereby minimizing the fueling time within a range in which the hydrogen pressure, temperature, and state of charge (SOC) inside the hydrogen tank do not exceed preset thresholds.

BRIEF DESCRIPTION OF THE DRAWINGS

A more complete appreciation of the present disclosure and many of the attendant aspects thereof will be readily obtained as the same becomes better understood by reference to the following detailed description when considered in connection with the accompanying drawings, wherein.

DETAILED DESCRIPTION OF EXEMPLARY EMBODIMENTS

Figure 1:
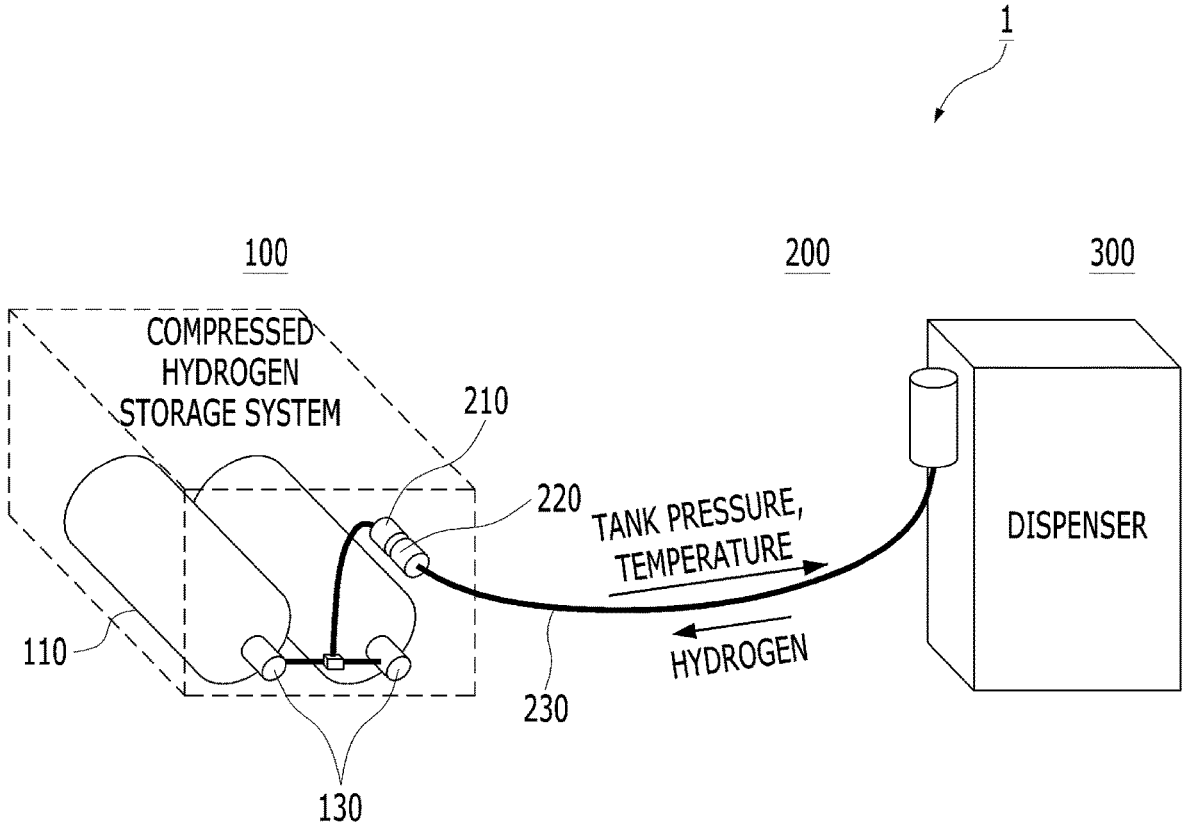
FIG. 1 is a view illustrating a hydrogen safe fueling system based on real-time communication information from a CHSS for fuel cells according to an embodiment.

Hereinafter, exemplary embodiments of the inventive concept will be described in detail with reference to the accompanying drawings. The inventive concept, however, may be modified in various different ways, and should not be construed as limited to the embodiments set forth herein. Like reference denotations may be used to refer to the same or similar elements throughout the specification and the drawings. However, the present disclosure may be implemented in other various forms and is not limited to the embodiments set forth herein. For clarity of the disclosure, irrelevant parts are removed from the drawings, and similar reference denotations are used to refer to similar elements throughout the specification.

In embodiments of the present disclosure, when an element is "connected" with another element, the element may be "directly connected" with the other element, or the element may be "electrically connected" with the other element via an intervening element. When an element "comprises" or "includes" another element, the element may further include, but rather than excluding, the other element, and the terms "comprise" and "include" should be appreciated as not excluding the possibility of presence or adding one or more features, numbers, steps, operations, elements, parts, or combinations thereof.

When the measurement of an element is modified by the term "about" or "substantially," if a production or material tolerance is provided for the element, the term "about" or "substantially" is used to indicate that the element has the same or a close value to the measurement and is used for a better understanding of the present disclosure or for preventing any unscrupulous infringement of the disclosure where the exact or absolute numbers are mentioned. As used herein, "step of" A or "step A-ing" does not necessarily mean that the step is one for A.

As used herein, the term "part" may mean a unit or device implemented in hardware, software, or a combination thereof. One unit may be implemented with two or more hardware devices or components, or two or more units may be implemented in a single hardware device or component. However, the components are not limited as software or hardware but may rather be configured to be stored in a storage medium or to execute one or more processors. Accordingly, as an example, a 'unit' includes elements, such as software elements, object-oriented software elements, class elements, and task elements, processes, functions, attributes, procedures, subroutines, segments of program codes, drivers, firmware, microcodes, circuits, data, databases, data architectures, tables, arrays, and variables. A function provided in an element or a 'unit' may be combined with additional elements or may be split into sub elements or sub units. Further, an element or a 'unit' may be implemented to process one or more CPUs in a device or a security multimedia card.

As used herein, some of the operations or functions described to be performed by a terminal or device may be, instead of the terminal or device, performed by a server connected with the terminal or device. Likewise, some of the operations or functions described to be performed by a server may be performed by a terminal or device connected with the server, instead of the server.

As used herein, some of the operations or functions described to be mapped or matched with a terminal may be interpreted as mapping or matching the unique number of the terminal, which is identification information about the terminal, or personal identification information.

Hereinafter, embodiments of the disclosure are described in detail with reference to the accompanying drawings.

Figure 2:
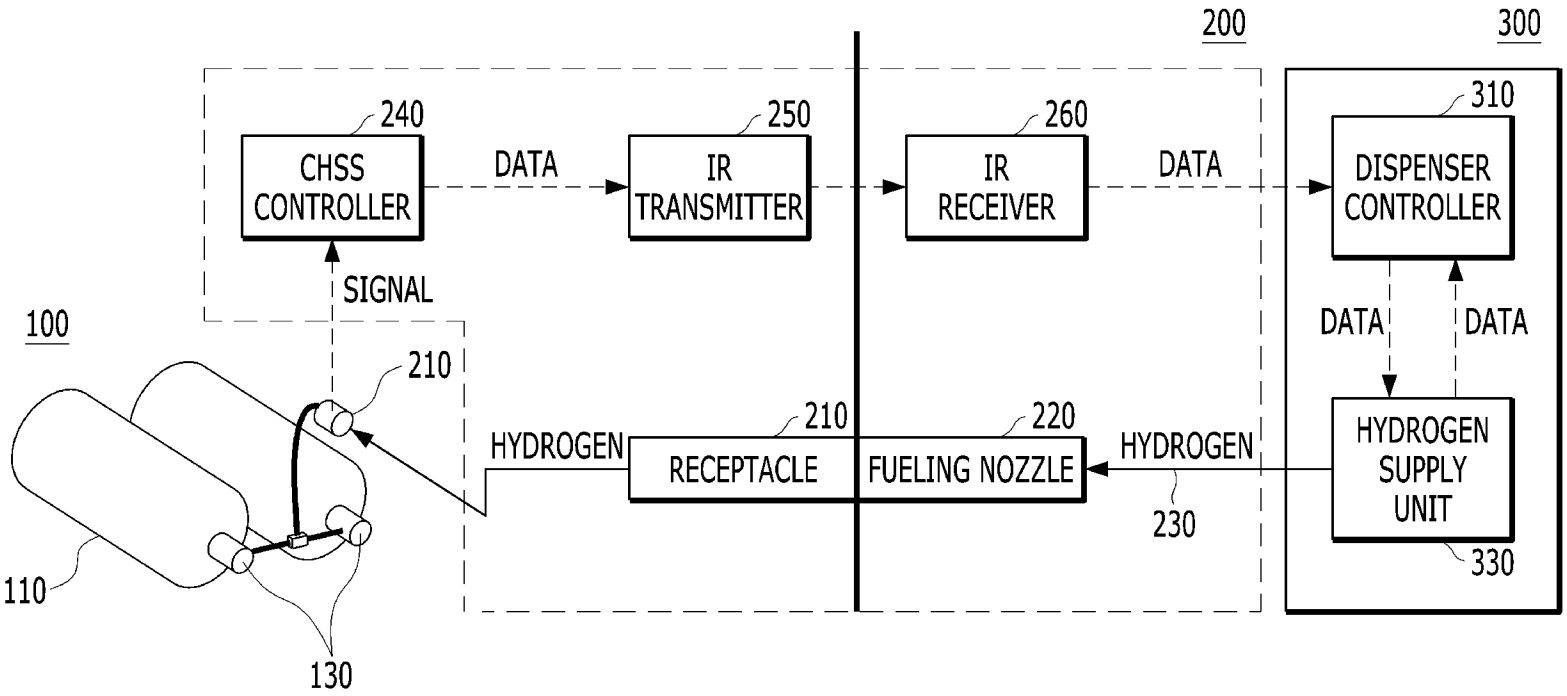
FIG. 2 is a block diagram illustrating an internal configuration of a system as shown in FIG. 1.

FIG. 1 is a view illustrating a hydrogen safe fueling system based on real-time communication information from a compressed hydrogen storage system (CHSS) for fuel cells according to an embodiment. FIG. 2 is a block diagram illustrating an internal configuration of a system as shown in FIG. 1.

Referring to FIG. 1, a hydrogen safe fueling system 1 based on real-time communication information from a CHSS for fuel cells may include at least one compressed hydrogen storage system (CHSS) 100, a data hydrogen moving device 200, and a dispenser 300. However, the hydrogen safe fueling system 1 is merely an example, and the scope of the present disclosure is not limited by FIG. 1.

The components of the system 1 of FIG. 1 are connected together via a network 200. For example, as shown in FIG. 1, the at least one CHSS 100 may be connected with the data hydrogen moving device 200 via a network. The data hydrogen moving device 200 may be connected with the at least one CHSS 100 and the dispenser 300 via the network. The dispenser 300 may be connected with the data hydrogen moving device 200 via the network.

Here, the network means a connection structure capable of exchanging information between nodes, such as a plurality of terminals or servers, and examples of the network include local area networks (LANs), wide area networks (WANs), internet (world wide web (WWW)), wired/wireless data communication networks, telephony networks, or wired/wireless television communication networks. Examples of the wireless data communication networks may include, but are not limited to, 3G, 4G, or 5G networks, 3rd Generation Partnership Project (3GPP) networks, Long Term Evolution (LTE) networks, Long Term Evolution-Advanced (LTE-A) networks, World Interoperability for Microwave Access (WIMAX) networks, Internet, Local Area Networks (LANs), wireless LANs, Wide Area Networks (WANs), Personal Area Networks (PANs), Bluetooth networks, near-field communication (NFC) networks, satellite broadcast networks, analog broadcast networks, and Digital Multimedia Broadcasting (DMB) networks.

As used herein, the singular forms "a," "an," and "the" are intended to include the plural forms as well, unless the context clearly indicates otherwise. According to embodiments, a plurality of components of the same type may be a single component of the type, and one component may add one or more components of the same type.

Each component of FIG. 1 is described below in connection with FIG. 2.

The CHSS 100 may include a hydrogen tank 110 and a hydrogen tank valve 130. The CHSS 100 may include a plurality of hydrogen tanks 100. The CHSS is installed in a hydrogen vehicle and is provided to receive and store hydrogen as a fuel. The hydrogen tank valve 130 includes a pressure sensor and a temperature sensor and measure the pressure and temperature of hydrogen supplied to the hydrogen tank 110 and transfer the measurements to a CHSS controller 240 of the data hydrogen moving device 200.

The data hydrogen moving device 200 may include a receptacle 210 to transfer the hydrogen dispensed from a hydrogen supply unit 330 to the hydrogen tank valve 130, a wireless communication unit provided for communication between the CHSS controller 240 and a dispenser controller 310 in the dispenser 300, and the CHSS controller 240 to convert sensing data into data for wireless communication and output the sensing data. The data hydrogen moving device 200 may further include a fueling nozzle 220 connected between the receptacle 210 and the hydrogen supply unit 330 to supply hydrogen to the hydrogen tank 110 via the hydrogen tank valve 130. The wireless communication unit may include an infrared (IR) transmitter 250 that is connected with the CHSS controller 240 which is installed on one side of the receptacle 210 through which hydrogen is injected to the vehicle and an IR receiver 260 having one end connected with the IR transmitter 250 and the opposite end connected with the dispenser controller 310.

The dispenser 300 may include the dispenser controller 310 to receive sensing data including the temperature and pressure of the hydrogen inside the hydrogen tank 110 and the hydrogen supply unit 330 to supply hydrogen to the hydrogen tank 110 based on the sensing data. The dispenser controller 310 may receive data from the wireless communication unit and the hydrogen supply unit 330, calculate a real-time pressure ramp rate inside the hydrogen supply unit 330, and provide the calculated pressure ramp rate to the hydrogen supply unit 330.

Operations of the CHSS real-time communication information-based hydrogen safe fueling system of FIGS. 1 and 2 are described below in detail with reference to FIGS. 3 and 4. However, what is described below is merely an example, and embodiments of the disclosure are not limited thereto.

Figure 3:
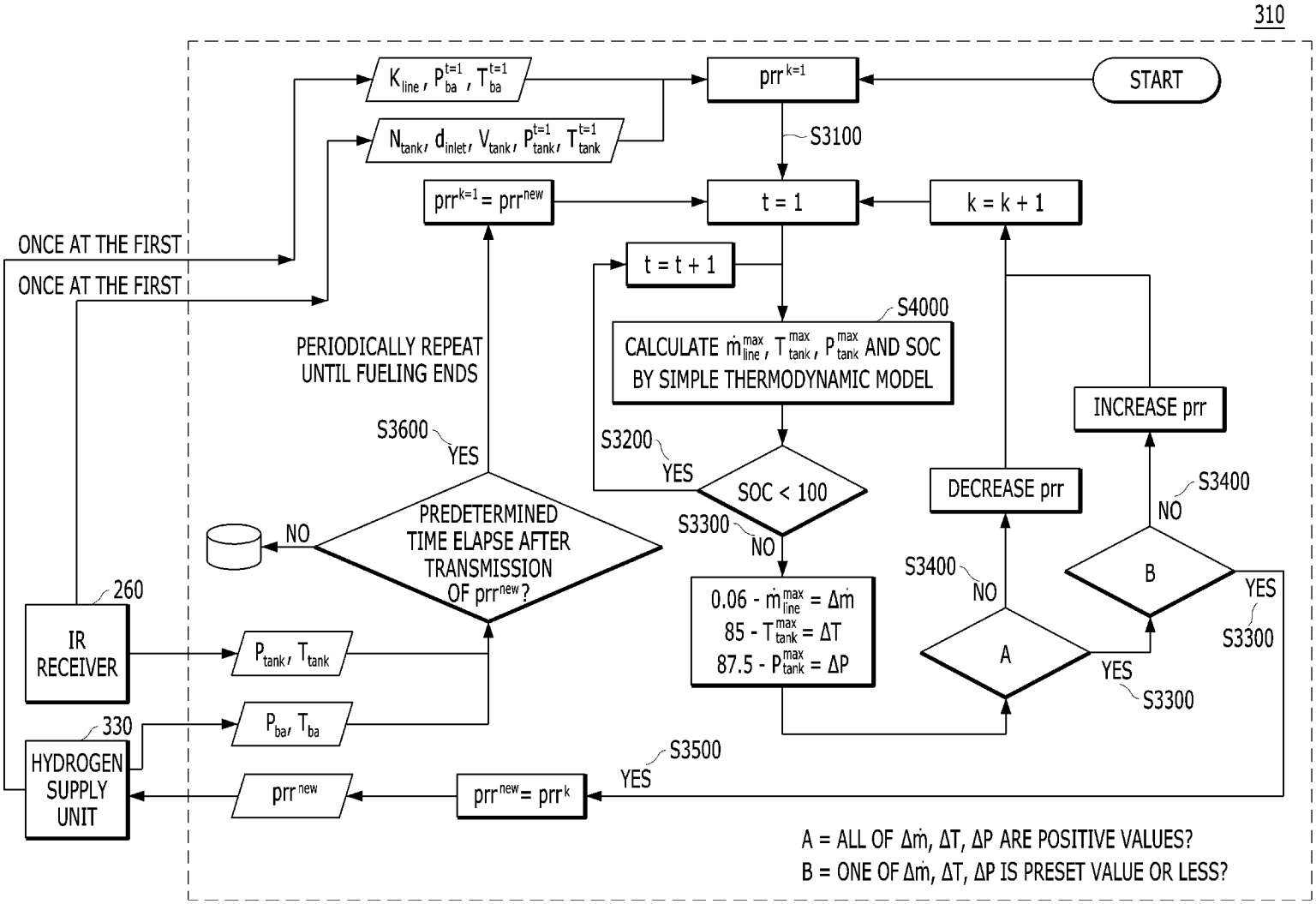
FIG. 3 is a flowchart illustrating a method of fueling by a dispenser controller of a hydrogen safe fueling system based on real-time communication information from a CHSS for fuel cells according to an embodiment.

FIG. 3 is a flowchart illustrating a method of fueling by a dispenser controller of a hydrogen safe fueling system based on real-time communication information from a CHSS for fuel cells according to an embodiment. FIG. 4 is a flowchart illustrating a method of driving a simple thermodynamic model of FIG. 3.

Referring to FIG. 3, according to an embodiment, the hydrogen safe fueling system 1 based on real-time communication information from a CHSS for fuel cells enables hydrogen fueling more quickly and safely, based on the structural information and thermodynamic information about the hydrogen tank, which is sent from the CHSS to the dispenser 300 via wireless communication while filling the hydrogen tank with hydrogen. To that end, the CHSS 100 may measure, in real-time, the pressure and temperature inside the hydrogen tank 110, and the dispenser 300 may receive the pressure and temperature from the CHSS 100, calculate the optimal pressure ramp rate, and allow hydrogen fueling to be performed at the calculated optimal pressure ramp rate. Thus, hydrogen fueling time may be minimized within a range in which the pressure, temperature, and filling flow rate of hydrogen in the hydrogen tank 110 do not depart from preset thresholds.

The approximations mentioned in FIGS. 3 and 4 may be described with reference to Table 1 below, and no duplicate description is given.

TABLE 1

| | |
|---|---|
| prr | Pressure Ramp Rate, MPa/s |
| m | Mass flow rate of compressed hydrogen, kg/s |
| t | Time counted for HRS, m/s |
| ρ | Gas density, kg/m$^3$ |
| ba | Break away |
| inlet | Inlet of vehicle tank |
| line | Hydrogen fueling line |
| max | Maximum value |
| new | New parameter to continue simulation |
| Cv | Specific heat capacity at constant volume, kJ/kg · K |
| hs | Stagnation enthalpy, kJ/kg |
| N | Number of tanks |
| K | Pressure drop coefficient of fueling line, m$^{-4}$ |
| k | Number of prr calculations |
| d | Diameter of tank inlet tube, m |
| u | Internal energy, kJ/kg |
| tank | Vehicle tank |
| R | Universal Gas Constant(8.314472), J/mol · K |
| m | Mass of compressed hydrogen, kg |
| V | Volume, m$^3$ |
| P | Pressure, MPa |
| T | Temperature, K |
| h | Static enthalpy, kJ/kg |
| Z | Compressibility factor |
| SOC | State Of Charge, % |

FIG. 3 illustrates a process in which the dispenser controller 310 receives data from the IR receiver 260 and the hydrogen supply unit 330, calculates a new pressure ramp rate ($prr^{new}$, optimal pressure ramp rate. and provides the calculated pressure ramp rate to the hydrogen supply unit 330. To that end, the dispenser controller 310 of the dispenser 300 performs the algorithm shown in FIG. 3.

<First Step>

In the first step S3100, the dispenser controller 310 may gather initial state values from the hydrogen tank 110 of the CHSS 100 and the hydrogen supply unit 330 of the dispenser 300. The initial state values may include the structural variable values of the hydrogen tank 110, the structural variable values of the data hydrogen moving device 200, the initial thermodynamic variable values of the gas supplied by the dispenser 300, and the thermodynamic variable values of the hydrogen in the hydrogen tank 110.

The structural variable values of the hydrogen tank 110 may include the number ($N_{tank}$) of the hydrogen tanks 110, the inner diameter ($d_{inlet}$) of the inlet of the hydrogen tank 110, and the volume ($V_{tank}$) of the hydrogen tank 110. In this case, it is hypothesized that all of the hydrogen tanks 110 included in one CHSS 100 have the same structural variables. For example, it is assumed that the number of the hydrogen tanks 110 in the CHSS 100 and the inner diameter and volume thereof each have the same standard value. These values are received by the dispenser controller 310 via the IR receiver 260 and, since these values are unique values of the CHSS 200, these values may be received only once before hydrogen fueling begins.

The structural variable values of the data hydrogen moving device 200 may include the pressure loss coefficient ($K_{line}$) of the data hydrogen moving device 200 which is measured by the hydrogen supply unit 330. Since the pressure loss coefficient is also a unique value of the data hydrogen moving device 200 which is also referred to as a fueling line or hydrogen fueling line, the pressure loss coefficient may also be received only one time before hydrogen fueling starts. However, since the pressure loss coefficient ($K_{line}$) is a unique value of the data hydrogen moving device 200 but may be varied depending on the kind of the CHSS 100, the pressure loss coefficient ($K_{line}$) of the entire data hydrogen moving device 200 may also be varied depending on the kind of the CHSS 100. The pressure loss coefficient may be obtained using the pressure loss value ($\Delta P_{line}$) obtained upon leakage check on the data hydrogen moving device 200 before hydrogen fueling starts, the density ($\rho_{line}$) of hydrogen in the data hydrogen moving device 200, and Equation 1 below. Here, $\dot{m}_{line}$ is the mass flow (hydrogen flow rate).

$$\Delta P_{line} = K_{line}\frac{\dot{m}_{line}^2}{\rho_{line}} \quad \text{[Equation 1]}$$

The initial thermodynamic variable values of the gas supplied by the dispenser 300 may include the pressure ($P_{ba}^{t=1}$) and temperature ($T_{,ba}^{t=1}$) of the hydrogen supplied by the dispenser 300. As these values, the ambient temperature measured around the dispenser 300 may be used. The thermodynamic variable values of the hydrogen in the hydrogen tank 110 may include the pressure ($P_{tank}^{t=1}$) and temperature ($T_{tank}^{t=1}$) of the hydrogen tank 110 which are gathered by the temperature sensor and pressure sensor embedded in the hydrogen tank valve 130 of the hydrogen tank 110.

The initial pressure ramp rate (prr) for calculating the new pressure ramp rate ($prr^{new}$) may be the value obtained by dividing 20 MPa/min by the number of hydrogen tanks 110. A hydrogen fueling simulation is performed using the initial values of these variables to calculate the new pressure ramp rate ($prr^{new}$), and the new pressure ramp rate is applied to hydrogen fueling. Thus, the initial pressure ramp rate (prr) may be of no significance in practice. According to an embodiment, an intermediate value of the values empirically known may be adopted to save the time taken to discover a proper initial pressure ramp rate (prr).

<Second Step>

In the second step S3200, the dispenser controller 310 may determine the mass flow and the temperature, pressure, and state of charge (SOC) of the hydrogen tank using a pre-stored simple thermodynamic model based on the initial state values. For example, in the second step S3200, the mass flow ($\dot{m}_{line}$), the temperature ($T_{tank}$) inside the hydrogen tank 110, the pressure ($P_{tank}$) inside the hydrogen tank 110, and the state of charge (SOC) are calculated using the simple thermodynamic model based on the initial values given in the first step S3100, and relatively larger values as compared with the resultant values of the simple thermodynamic model are selected to thereby determine the maximum mass flow ($\dot{m}_{line}^{max}$) maximum hydrogen tank temperature ($T_{tank}^{max}$), and the maximum hydrogen tank pressure ($P_{tank}^{max}$). The process of the simple thermodynamic model-based calculation is repeated while incrementing the time by $\Delta t$ and, if the state of charge (SOC) becomes 100 or more, the repeated calculation is stopped.

<Third Step>

The dispenser controller 310 may calculate the differences between each of the determined mass flow, temperature, and pressure and each pre-stored safety threshold. In this case, the dispenser controller 310 may determine that the pressure ramp rate when all of the differences as a result of the repeated calculation are positive (+) values while one of the differences becomes each pre-stored set value or less. In this case, each pre-set set value may be configured based on an acceptable small value, e.g., based on the results of research. The third step S3300 may be a simulation result determining step. In the third step S3300, the dispenser controller 310 compares the maximum flow rate ($\dot{m}_{line}^{max}$), maximum hydrogen tank temperature ($T_{tank}^{max}$), and maximum hydrogen tank pressure ($P_{tank}^{max}$) with the safety thresholds (e.g., 0.06 kg/s, 85° C., and 87.5 MPa), respectively, thereby obtaining the differences, i.e., $\Delta\dot{m}$, $\Delta T$, and $\Delta P$, respectively. In this case, what is intended by the dispenser controller 310 is to shorten the time required for hydrogen fueling by maximizing the initial pressure ramp rate (prr) within a range in which the maximum mass flow ($\dot{m}_{line}^{max}$), maximum hydrogen tank temperature ($T_{tank}^{max}$), and maximum hydrogen tank pressure ($P_{tank}^{max}$) do not exceed the safety thresholds. If any one of the three values exceeds its corresponding safety threshold, this may end up violating relevant rules. Thus, if all of $\Delta\overline{m}$, $\Delta T$, and $\Delta P$ are positive (+) values, and one of $\Delta\dot{m}$, $\Delta T$, and $\Delta P$ is a preset value, e.g., a small value as acceptable (based on the results of research), the applicable pressure ramp rate (prr) may be set to, and regarded as, the optimal pressure ramp rate (prr). In this case, since the regarded optimal pressure ramp rate (prr) is not the actual optimal pressure ramp rate, the optimal pressure ramp rate (prr) is first set and then the actual pressure ramp rate is discovered and applied in the fourth step below.

<Fourth Step>

The dispenser controller 310 may discover and apply the pressure ramp rate of the hydrogen supply unit 110 based on the calculated differences. In this case, the fourth step may include a discovery step S3400 and an application step S3500. In the discovery step S3400, unless all of $\Delta\dot{m}$, $\Delta T$, and $\Delta P$ are positive (+) values, i.e., if any one of the values is a negative (−) value, the dispenser controller 310 reduces the pressure ramp rate (prr) and, if all of $\Delta\dot{m}$, $\Delta T$, and $\Delta P$ are positive values, but one of $\Delta\dot{m}$, $\Delta T$, and $\Delta P$ is not the preset value, i.e., the small value as acceptable, or less, the dispenser controller 310 increases the pressure ramp rate (prr) and repeats the second step S3200 and the third step S3300 to thereby discover the optimal pressure ramp rate (prr). In the application S3500, the dispenser controller 310 sets the optimal pressure ramp rate (prr) discovered in steps S3100 to S3400 as a new pressure ramp rate ($prr^{new}$) and transmits the new pressure ramp rate to the hydrogen supply unit 330 so that the hydrogen supply unit 330 may continue to fill the hydrogen tank 110 of the CHSS 100 at the new pressure ramp rate ($prr^{new}$).

<Fifth Step>

If a preset time elapses after discovering the pressure ramp rate of the hydrogen supply unit 110 based on the calculated differences and applying the discovered pressure ramp rate, the dispenser controller 310 may recalculate a new optimal pressure ramp rate based on the temperature and pressure of the hydrogen tank 110 and the temperature and pressure of the hydrogen supply unit 330. This step may be a step S3600 for requesting to calculate a new optimal pressure ramp rate ($prr^{new}$) and may be a step for requesting to update the new pressure ramp rate ($prr^{new}$) applied in step S3500. For example, when a predetermined time, e.g., two seconds, elapses, based on the pressure ($P_{tank'}$) and temperature ($T_{tank'}$) of the new hydrogen tank 100 received from the IR receiver 260 and the hydrogen supply unit 330 and the pressure ($P_{ba'}$) and temperature ($T_{ba'}$) of the data hydrogen moving device 200, a new optimal pressure ramp rate ($prr^{new}$) may be recalculated. For example, if the pressure ramp rate is A at 0 seconds, the pressure ramp rate at two seconds may be recalculated to B and, two seconds thereafter, i.e., at four seconds, the pressure ramp rate may become C. In such a manner, the pressure ramp rate may be continuously updated to a new optimal pressure ramp rate ($prr^{new}$) (A-B-C).

According to an embodiment, the thermodynamic model used in the hydrogen fueling simulation does not reflect heat transfer in the data hydrogen moving device 200 and the hydrogen tank 110. Thus, an error may occur in the calculation of the temperature of hydrogen in the hydrogen tank 110. However, since the hydrogen fueling simulation is performed based on the pressure and temperature inside the hydrogen tank 110 in the current state, errors may reduce if the duration of the simulation is sufficiently short. Thus, the hydrogen fueling simulation may be repeated during the remaining fueling time until immediately before the hydrogen fueling is terminated.

The order of the above-described steps S3100 to S3600 is merely an example, and embodiments of the disclosure are not limited thereto. In other words, the above-described steps S3100 to S3600 may be performed in a different order, or some of the steps may be simultaneously performed or omitted.

Figure 4:
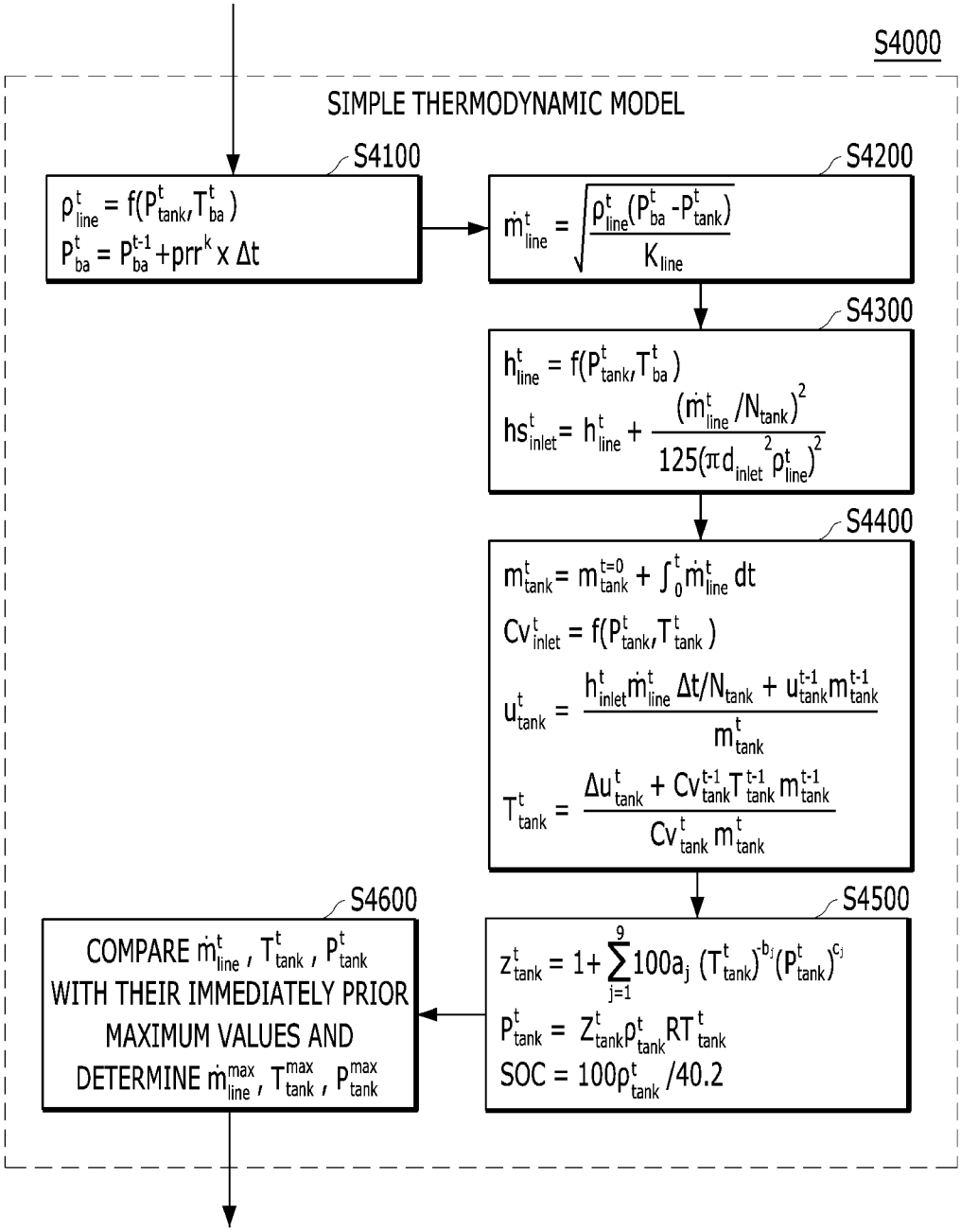
FIG. 4 is a flowchart illustrating a method of driving the simple thermodynamic model of FIG. 3, according to an embodiment.

FIG. 4 is a flowchart illustrating an operational process of a simple thermodynamic model according to an embodiment of the disclosure. In the simple thermodynamic model according to an embodiment of the disclosure, the initial values and the data received from the IR receiver 260 and the hydrogen supply unit 330 are used to calculate the mass flow ($\dot{m}_{line}^{t}$), the temperature ($T_{tank}^{t}$) of the hydrogen tank 110, the pressure ($P_{tank}^{t}$) of the hydrogen tank 110, and the state of charge (SOC), which are then compared with their immediately prior values, thereby determining the maximum mass flow ($\dot{m}_{line}^{max}$), maximum hydrogen tank temperature ($T_{tank}^{max}$), and maximum hydrogen tank pressure ($P_{tank}^{max}$). This step is a sub-step of step S3200 and, thus, the components or operations described above in connection with S3200 are not repeatedly described below. Steps S3100 to S3600 denoted the first step to the fifth step in FIG. 3 are defined as different steps from a first step S4100 to a sixth step S4600 below.

<First Step>

The dispenser controller 310 may set a supplied hydrogen pressure of the dispenser 300. In the first step S4100, the pressure of hydrogen supplied from the dispenser 300 is set. The supplied hydrogen pressure of the dispenser 300 may be calculated using Equation 2 below based on the supplied hydrogen pressure ($P_{ba}^{t-1}$) of the immediately prior time step (−Δt), the pressure ramp rate ($prr^{k}$) of the current step, and the hydrogen fueling simulation time period (Δt).

$$P_{ba}^{t}=P_{ba}^{t-1}+(prr^{k}\times\Delta t) \quad \text{[Equation 2]}$$

<Second Step>

The dispenser controller 310 may calculate the mass flow which is the hydrogen flow rate of the data hydrogen moving device 200 (S4200). The mass flow ($\dot{m}_{line}^{t}$) of the data hydrogen moving device 200 may be obtained using Equation 3 based on the hydrogen density ($\rho_{line}^{t}$) in the data hydrogen moving device 200, the pressure ($P_{ba}^{t}$) of the hydrogen supplied by the dispenser 300, the pressure ($P_{tank}^{t}$) of the hydrogen tank 110, and the pressure loss coefficient ($K_{line}$) of the data hydrogen moving device 200. As the difference between the pressure at which the dispenser 300 supplies hydrogen and the pressure of the hydrogen tank 110 increases, and the pressure loss coefficient ($K_{line}$) decreases, the mass flow ($\dot{m}_{line}^{t}$) of the data hydrogen moving device 200 tends to rise.

$$\dot{m}_{line}^{t}=\sqrt{\frac{\rho_{line}^{t}(P_{ba}^{t}-P_{tank}^{t})}{K_{line}}} \quad \text{[Equation 3]}$$

<Third Step>

The dispenser controller 310 may calculate the stagnation enthalpy of the hydrogen flowing into the hydrogen tank 110. In the third step S4300, the stagnation enthalpy ($hs^{t}_{inlet}$) of the hydrogen flowing into the hydrogen tank 110 may be obtained using Equation 4 based on the enthalpy ($h_{line}^{t}$) which is the function of the temperature and pressure of the hydrogen flowing into the hydrogen tank 110, the mass flow ($\dot{m}_{line}^{t}$), the number ($N_{tank}$) of the hydrogen tanks 110 connected in parallel, the inner diameter ($d_{inlet}$) of the inlet of the hydrogen tank 110, and the density ($\rho_{line}^{t}$) of hydrogen inside the data hydrogen moving device 200. If the number ($N_{tank}$) of hydrogen tanks 110 connected in parallel increases, the flow velocity of the hydrogen flowing into each hydrogen tank 110 reduces and, thus, the stagnation enthalpy decreases. If the inlet inner diameter ($d_{inlet}$) of the hydrogen tank 110 reduces, the flow velocity of the hydrogen flowing into the hydrogen tank 110 increases and so does the stagnation enthalpy.

$$hs_{inlet}^{t}=h_{line}^{t}+\frac{(\dot{m}_{line}^{t}/N_{tank})^{2}}{125(\pi d_{inlet}^{2}\rho_{line}^{t})^{2}} \quad \text{[Equation 4]}$$

<Fourth Step>

The dispenser controller 310 may calculate the temperature inside the hydrogen tank 110. In the fourth step S4400, the temperature inside the hydrogen tank 110 may be obtained using Equation 5 based on the internal energy variation ($\Delta u_{tank}^{t}$) inside the hydrogen tank 110 and the specific heat capacity ($Cv_{tank}^{t}$) of hydrogen inside the hydrogen tank 110. In Equation 5, the specific heat capacity ($Cv_{tank}^{t}$), the temperature ($T_{tank}^{t}$) of the hydrogen tank 110, and the pressure ($P_{tank}^{t}$) of the hydrogen tank 110 need to be determined to obtain the internal temperature inside the hydrogen tank 110. However, in an embodiment of the disclosure, from an order of calculation standpoint, it may be required to, before calculating the temperature ($T_{tank}^{t}$) of the hydrogen tank 110 and the pressure ($P_{tank}^{t}$) of the hydrogen tank 110, calculate the specific heat capacity ($Cv_{tank}^{t}$). Thus, the calculation is performed by applying, instead of the temperature ($T_{tank}^{t}$) of the hydrogen tank 110 and the pressure ($P_{tank}^{t}$) of the hydrogen tank 110, the temperature ($T_{tank}^{t-1}$) of the hydrogen tank 110 and the pressure ($P_{tank}^{t-1}$) of the hydrogen tank 110. Resultantly, although the resultant temperature ($T_{tank}^{t}$) of the hydrogen tank 110 is higher than the actual value, since it results it conservative results, there is no safety issue.

$$T_{tank}^{t}=\frac{\Delta u_{tank}^{t}+Cv_{tank}^{t-1}T_{tank}^{t-1}m_{tank}^{t-1}}{Cv_{tank}^{t}m_{tank}^{t}} \quad \text{[Equation 5]}$$

<Fifth Step>

The dispenser controller 310 may calculate the state of charge (SOC) corresponding to the pressure inside the hydrogen tank 110 and the degree at which the hydrogen tank 110 is filled with hydrogen (S4500). To increase the storage efficiency, hydrogen is compressed at a few tens of MPa, and it may be impossible to apply the ideal gas equation to high-pressure compressed hydrogen. To obtain the pressure ($P_{tank}^{t}$) of the hydrogen tank 110, the compressibility factor of hydrogen needs to be known. To precisely calculate the pressure of hydrogen whose temperature tends to rise due to the Joule-Thomson effect upon adiabatic expansion, the compressibility factor needs to be calculated using a state equation reflecting such tendency. Equations 6 to 8 are used which are special hydrogen state equations developed according to an embodiment of the disclosure. According to Equations 6 to 8, the pressure ($P_{tank}^{t}$) and state of charge (SOC) of the hydrogen tank 110 may be obtained. Here, R is the universal gas constant which is defined in Table 1.

$$Z_{tank}^{t} = 1 + \sum_{j=1}^{9} 100a_j (T_{tank}^{t})^{-b_j} (P_{tank}^{t})^{c_j} \quad \text{[Equation 6]}$$

$$P_{tank}^{t} = Z_{tank}^{t} \rho_{tank}^{t} R T_{tank}^{t} \quad \text{[Equation 7]}$$

$$SOC = \frac{100^{t}_{\rho_{tank}}}{40.2} \quad \text{[Equation 8]}$$

<Sixth Step>

The dispenser controller 310 may determine the maximum mass flow corresponding to the maximum hydrogen flow rate of the data hydrogen moving device 200 and the maximum pressure and maximum temperature of the hydrogen tank 110. The mass flow ($\dot{m}_{line}^{t}$) of the data hydrogen moving device 200, the pressure ($P_{tank}^{t}$) of the hydrogen tank 110, and the temperature ($T_{tank}^{t}$) of the hydrogen tank 110, which have been calculated in the above steps are compared with their respective immediately prior maximum values, determining the maximum mass flow ($\dot{m}_{line}^{max}$), the maximum hydrogen tank temperature ($T_{tank}^{max}$), and the maximum hydrogen tank pressure ($P_{tank}^{max}$). According to hydrogen fueling safety standards, regulations require that the safety thresholds be not exceeded during hydrogen fueling, as well as at the time of termination of hydrogen fueling. Thus, according to an embodiment of the disclosure, the maximum mass flow ($\dot{m}_{line}^{max}$), the maximum hydrogen tank temperature ($T_{tank}^{max}$), and the maximum hydrogen tank pressure ($P_{tank}^{max}$) are set as variables to be controlled.

The order of the above-described steps S4100 to S4600 is merely an example, and embodiments of the disclosure are not limited thereto. In other words, the above-described steps S4100 to S4600 may be performed in a different order, or some of the steps may be simultaneously performed or omitted.

What is not described regarding the hydrogen fueling method based on real-time communication of a CHSS for fuel cells in connection with FIGS. 3 and 4 is the same or easily inferred from what has been described regarding the hydrogen fueling method based on real-time communication of a CHSS for fuel cells in connection with FIGS. 1 and 2, and no detailed description thereof is thus presented.

The hydrogen fueling method based on real-time communication of a CHSS for fuel cells according to an embodiment described with reference to FIGS. 3 and 4 may be implemented in the form of a recording medium or computer-readable medium containing computer-executable instructions or commands, such as an application or program module executable on a computer. The computer-readable medium may be an available medium that is accessible by a computer. The computer-readable storage medium may include a volatile medium, a non-volatile medium, a separable medium, and/or an inseparable medium. The computer-readable medium may include a computer storage medium. The computer storage medium may include a volatile medium, a non-volatile medium, a separable medium, and/or an inseparable medium that is implemented in any method or scheme to store computer-readable commands, data architecture, program modules, or other data or information.

Although embodiments of the present disclosure have been described with reference to the accompanying drawings, It will be appreciated by one of ordinary skill in the art that the present disclosure may be implemented in other various specific forms without changing the essence or technical spirit of the present disclosure. Thus, it should be noted that the above-described embodiments are provided as examples and should not be interpreted as limiting. Each of the components may be separated into two or more units or modules to perform its function(s) or operation(s), and two or more of the components may be integrated into a single unit or module to perform their functions or operations.

It should be noted that the scope of the present disclosure is defined by the appended claims rather than the described description of the embodiments and include all modifications or changes made to the claims or equivalents of the claims.

What is claimed is:

1. A hydrogen fueling method performed by a dispenser, comprising:

obtaining first initial state values of hydrogen dispensed from a hydrogen supply unit of the dispenser and second initial state values of at least one hydrogen tank of a compressed hydrogen storage system (CHSS);

determining a mass flow rate, a temperature of the hydrogen tank and a pressure of the hydrogen tank and a state of charge (SOC) using a pre-stored thermodynamic model based on the first initial state values and the second initial state values;

calculating each difference if the determined SOC is not less than a preset SOC; and determining, based on the each difference, whether to reducing, increasing, or maintaining a pressure ramp rate (PRR) applied when the mass flow rate, the temperature of the hydrogen tank and the pressure of the hydrogen tank is determined, wherein the each difference comprises:

a first difference between the determined mass flow rate and a pre-stored first safety threshold related to the determined mass flow rate, a second difference between the determined temperature of the hydrogen tank and a pre-stored second safety threshold related to the determined temperature, and a third difference between the determined pressure of the hydrogen tank and a pre-stored third safety threshold related to the determined pressure.

2. The hydrogen fueling method of claim 1, further comprising:

if the determined SOC is less than the preset SOC, re-determining the determined mass flow rate, the determined temperature of the hydrogen tank, the determined pressure of the hydrogen tank and the determined SOC using the pre-stored thermodynamic model.

3. The hydrogen fueling method of claim 1, wherein the preset SOC is 100.

4. The hydrogen fueling method of claim 1, wherein:

the second initial state values include a number of the hydrogen tank, an inlet inner diameter of the hydrogen tank and a volume of the hydrogen tank, and the first initial state values include a pressure loss coefficient measured by the hydrogen supply unit, a pressure and temperature of hydrogen dispensed from the hydrogen supply unit.

5. The hydrogen fueling method of claim 1, further comprising:

if one of the each difference is a negative value, reducing the pressure ramp rate applied when the mass flow rate, the temperature and pressure is the determined;

re-determining the determined mass flow rate, the determined temperature of the hydrogen tank, the determined pressure of the hydrogen tank and the determined SOC using the pre-stored thermodynamic model, wherein the first difference is calculated by subtracting the determined mass flow rate from the pre-stored first safety threshold, the second difference is calculated by subtracting the determined temperature of the hydrogen tank from the pre-stored second safety threshold, and the third difference is calculated by subtracting the determined pressure of the hydrogen tank from the pre-stored third safety threshold.

6. The hydrogen fueling method of claim 1, wherein:

in comparison with previous values, the determined mass flow rate, the determined temperature of the hydrogen tank and the determined pressure of the hydrogen tank each corresponds to a maximum mass flow rate, a maximum temperature of the hydrogen tank and a maximum pressure of the hydrogen tank.

7. The hydrogen fueling method of claim 1, further comprising:

if all of the each difference are positive values and any one of the each difference is a preset value or less, determining, a pressure ramp rate applied when the mass flow rate, the temperature and pressure is the determined, as a new pressure ramp rate, wherein the first difference is calculated by subtracting the determined mass flow rate from the pre-stored first safety threshold, the second difference is calculated by subtracting the determined temperature of the hydrogen tank from the pre-stored second safety threshold, and the third difference is calculated by subtracting the determined pressure of the hydrogen tank from the pre-stored third safety threshold.

8. The hydrogen fueling method of claim 1, further comprising:

if all of each difference are positive values and if it is not that any one of the each difference is a preset value or less, determining a new pressure ramp rate by increasing the pressure ramp rate applied when the mass flow rate, the temperature and pressure is the determined, wherein the first difference is calculated by subtracting the determined mass flow rate from the pre-stored first safety threshold, the second difference is calculated by subtracting the determined temperature of the hydrogen tank from the pre-stored second safety threshold, and the third difference is calculated by subtracting the determined pressure of the hydrogen tank from the pre-stored third safety threshold.

9. The hydrogen fueling method of claim 1, wherein:

the second initial state values include a number of the hydrogen tank, an inlet inner diameter of the hydrogen tank and a volume of the hydrogen tank, and the first initial state values include a pressure loss coefficient measured by the hydrogen supply unit, a pressure and temperature of hydrogen dispensed from the hydrogen supply unit.

10. The hydrogen fueling method of claim 1, further comprising:

obtaining first real-time values including a real-time temperature of the hydrogen tank and a real-time pressure of the hydrogen tank and second real-time values including a real-time temperature and a real-time pressure of hydrogen dispensed from the hydrogen supply unit at a predetermined period; and repeating steps after the obtaining of the first initial state values and the second initial state values based on the first real-time values and the second real-time values.

11. A hydrogen dispenser for hydrogen fueling, comprising:

a hydrogen supply unit; and a dispenser controller configured to:

obtain the first initial state values from the hydrogen supply unit and second initial state values of at least one hydrogen tank of a compressed hydrogen storage system (CHSS), determine a mass flow rate, a temperature of the hydrogen tank and a pressure of the hydrogen tank and a state of charge (SOC) using a pre-stored thermodynamic model based on the first initial state values and the second initial state values, calculate each difference if the determined SOC is not less than a preset SOC, and determine, based on the each difference, whether to reducing, increasing, or maintaining a pressure ramp rate (PRR) applied when the mass flow rate, the temperature and the pressure is determined, wherein the each difference comprises:

a first difference between the determined mass flow rate and a pre-stored first safety threshold related to the determined mass flow rate, a second difference between the determined temperature of the hydrogen tank and a pre-stored second safety threshold related to the determined temperature, and a third difference between the determined pressure of the hydrogen tank and a pre-stored third safety threshold related to the determined pressure.

12. The hydrogen dispenser of claim 11, wherein if the determined SOC is less than the preset SOC, the dispenser controller is further configured to re-determine the determined mass flow rate, the determined temperature of the hydrogen tank, the determined pressure of the hydrogen tank and the determined SOC using the pre-stored thermodynamic model.

13. The hydrogen dispenser of claim 11, wherein if one of the each difference is a negative value, the dispenser controller is further configured to:

reduce the pressure ramp rate applied when the mass flow rate, the temperature and pressure is the determined, re-determine the determined mass flow rate, the determined temperature of the hydrogen tank, the determined pressure of the hydrogen tank and the determined SOC, calculate the first difference by subtracting the determined mass flow rate from the pre-stored first safety threshold, calculate the second difference by subtracting the determined temperature of the hydrogen tank from the pre-stored second safety threshold, and calculate the third difference by subtracting the determined pressure of the hydrogen tank from the pre-stored third safety threshold.

14. The hydrogen dispenser of claim 11, wherein if all of the each difference are positive values and any one of the each difference is a preset value or less, the dispenser controller is further configured to:

determine, a pressure ramp rate applied when the mass flow rate, the temperature and pressure is the determined, as a new pressure ramp rate, calculate the first difference by subtracting the determined mass flow rate from the pre-stored first safety threshold, calculate the second difference by subtracting the determined temperature of the hydrogen tank from the pre-stored second safety threshold, and calculate the third difference by subtracting the determined pressure of the hydrogen tank from the pre-stored third safety threshold.

15. The hydrogen dispenser of claim 11, wherein if all of each difference are positive values and if it is not that any one of the each difference is a preset value or less, the dispenser controller is further configured to:

determine a new pressure ramp rate by increasing the pressure ramp rate applied when the mass flow rate, the temperature and pressure is the determined, calculate the first difference by subtracting the determined mass flow rate from the pre-stored first safety threshold, calculate the second difference by subtracting the determined temperature of the hydrogen tank from the pre-stored second safety threshold, and calculate the third difference by subtracting the determined pressure of the hydrogen tank from the pre-stored third safety threshold.

16. The hydrogen dispenser of claim 11, wherein:

in comparison with previous values, the determined mass flow rate, the determined temperature of the hydrogen tank and the determined pressure of the hydrogen tank each corresponds to a maximum mass flow rate, a maximum temperature of the hydrogen tank and a maximum pressure of the hydrogen tank.

* * * * *